US010207902B2

(12) United States Patent
Bradshaw et al.

(10) Patent No.: US 10,207,902 B2
(45) Date of Patent: Feb. 19, 2019

(54) LOAD-MOUNTABLE LIFT EYE ASSEMBLY

(71) Applicant: MJT Holdings, LLC, Valdosta, GA (US)

(72) Inventors: Benjie Bradshaw, Valdosta, GA (US); Patrick Lawrence Giles, Hahira, GA (US)

(73) Assignee: MJT Holdings, LLC, Valdosta, GA (US)

( * ) Notice: Subject to any disclaimer, the term of this patent is extended or adjusted under 35 U.S.C. 154(b) by 0 days.

(21) Appl. No.: 15/823,424

(22) Filed: Nov. 27, 2017

(65) Prior Publication Data

US 2018/0079628 A1 Mar. 22, 2018

Related U.S. Application Data

(63) Continuation-in-part of application No. 29/576,349, filed on Sep. 1, 2016, now Pat. No. Des. 803,668.

(51) Int. Cl.
*B66C 1/66* (2006.01)

(52) U.S. Cl.
CPC ..... *B66C 1/66* (2013.01)

(58) Field of Classification Search
CPC ..... B66C 1/66; B66C 1/666; E04G 21/142; F16B 35/06; F16B 45/00
USPC ..... 294/215; 411/400
See application file for complete search history.

(56) References Cited

U.S. PATENT DOCUMENTS 1,761,978 A 6/1930 Black
2,748,646 A 6/1956 Harold et al.
D198,281 S 5/1964 Mills
3,492,033 A 1/1970 Mueller
4,068,878 A 1/1978 Wilner
(Continued)

FOREIGN PATENT DOCUMENTS

DE 202014102175 U1 7/2014
EP 0654611 A1 6/1995
(Continued)

OTHER PUBLICATIONS

International Search Report and Written Opinion in Applicant's co-pending PCT International Patent Application No. PCT/US2017/063331; dated Feb. 13, 2018.

*Primary Examiner* — Dean J Kramer
(74) *Attorney, Agent, or Firm* — Lance M. Pritkin

(57) ABSTRACT

Exemplary embodiments of a load-mountable lift eye assembly comprise a connection interface, a mounting coupler and an axial retention element. A bushing may be disposed radially between the mounting coupler and a mounting bore of the connection interface. The axial retention element may engage the mounting bore so as to retain a segment of a head portion of the mounting coupler between a shoulder flange of the mounting bore and the axial retention element, thereby retaining the mounting coupler in mounting position and limiting its ability to move axially with respect to the connection interface. The mounting coupler may include a head-shaft interface. In such case, when the mounting coupler is in its mounting position, the head-shaft interface may be axially offset from the mounting face of the connection interface. The mounting coupler may include a tool-engagement section adapted to be engaged by one or more types of torqueing tools.

19 Claims, 6 Drawing Sheets

(56) References Cited

U.S. PATENT DOCUMENTS

| | | | | |
|---|---|---|---|---|
| 4,408,941 | A | 10/1983 | Motz | |
| 4,419,785 | A | 12/1983 | McWhirter | |
| 4,570,987 | A | 2/1986 | Wong et al. | |
| 4,641,986 | A | 2/1987 | Tsui et al. | |
| 4,828,443 | A | 5/1989 | Simmons | |
| 5,054,982 | A | 10/1991 | Freeman | |
| 5,125,861 | A | 6/1992 | Freeman | |
| 5,183,360 | A * | 2/1993 | Freeman | B66C 1/66 294/82.1 |
| 5,439,338 | A | 8/1995 | Rosenberg | |
| 5,690,457 | A | 11/1997 | Smetz | |
| 5,743,678 | A | 4/1998 | Pitre | |
| D413,509 | S | 9/1999 | Robertson | |
| D417,139 | S | 11/1999 | Pitre | |
| 5,992,910 | A | 11/1999 | Kwon | |
| 6,039,500 | A | 3/2000 | Kwon | |
| 6,267,422 | B1 | 7/2001 | Alba | |
| 6,443,514 | B1 * | 9/2002 | Fuller | B66C 1/66 294/215 |
| 6,478,350 | B2 | 11/2002 | Zuliani | |
| 6,994,501 | B2 | 2/2006 | Smetz | |
| 7,393,033 | B1 | 7/2008 | Bisso, IV | |
| 7,783,519 | B2 | 8/2010 | Alba | |
| D638,695 | S | 5/2011 | Woodrow et al. | |
| 8,757,693 | B2 | 6/2014 | Fuller et al. | |
| D742,724 | S | 11/2015 | Smetz | |
| 9,188,151 | B2 | 11/2015 | Ivanic et al. | |
| 9,193,570 | B2 | 11/2015 | Norpoth | |
| 2015/0071732 | A1 * | 3/2015 | Hong | F16B 35/06 411/383 |

FOREIGN PATENT DOCUMENTS

| | | | | |
|---|---|---|---|---|
| EP | 2361870 | A1 * | 8/2011 | B66C 1/66 |
| EP | 2495459 | A1 | 9/2012 | |
| FR | 2880084 | A1 | 6/2006 | |
| WO | 2015014346 | A1 | 2/2015 | |

* cited by examiner

LOAD-MOUNTABLE LIFT EYE ASSEMBLY

RELATED APPLICATIONS

This application is a continuation-in-part of U.S. Design patent application Ser. No. 29/576,349 filed Sep. 1, 2016, the content of which is incorporated by this reference its entirety for all purposes as if fully set forth herein.

TECHNICAL FIELD

The present disclosure relates to connection devices for facilitating the lifting of heavy loads. More particularly, the present disclosure relates to a lifting eye assembly for attachment to a load to be lifted.

BACKGROUND

The conventional art of lifting eye assemblies is currently in need of a novel expedient capable of retaining its components in assembled form throughout its shipment and deployment, distributing lifting loads through the assembly more safely and efficiently, being mountable to a load using a variety of torqueing tools, and minimizing or eliminating any obstructions of the eyelet aperture.

SUMMARY

Certain deficiencies of the prior art are overcome by the provision of embodiments of a load-mountable lift eye assembly in accordance with the present disclosure. Preferred embodiments of the assembly include a connection interface element, a mounting coupler and an axial retention element. Certain preferred embodiments also include a bushing element disposed radially between the mounting coupler and a mounting bore of the connection interface element. The mounting coupler may include a head-shaft interface. In such case, when the mounting coupler is in its mounting position, the head-shaft interface may be axially offset from the mounting face of the connection interface element.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION OF THE PREFERRED EMBODIMENTS

Figure 1:
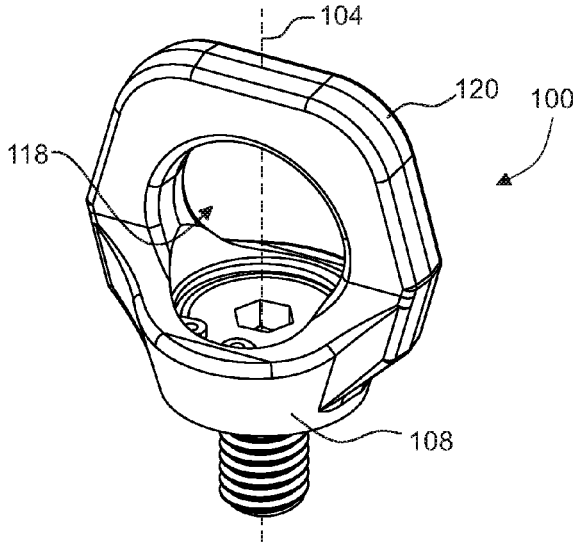
FIG. 1 is a diagrammatic perspective view of one example load-mountable lift eye assembly in accordance with the present disclosure.

Referring now to the drawings, like reference numerals designate identical or corresponding features throughout the several views.

With reference to the several drawings, various example embodiments of a load-mountable lift eye assembly are shown at 100, and may comprise a connection interface element 106, a mounting coupler 126 and an axial retention element 124.

Figure 3:
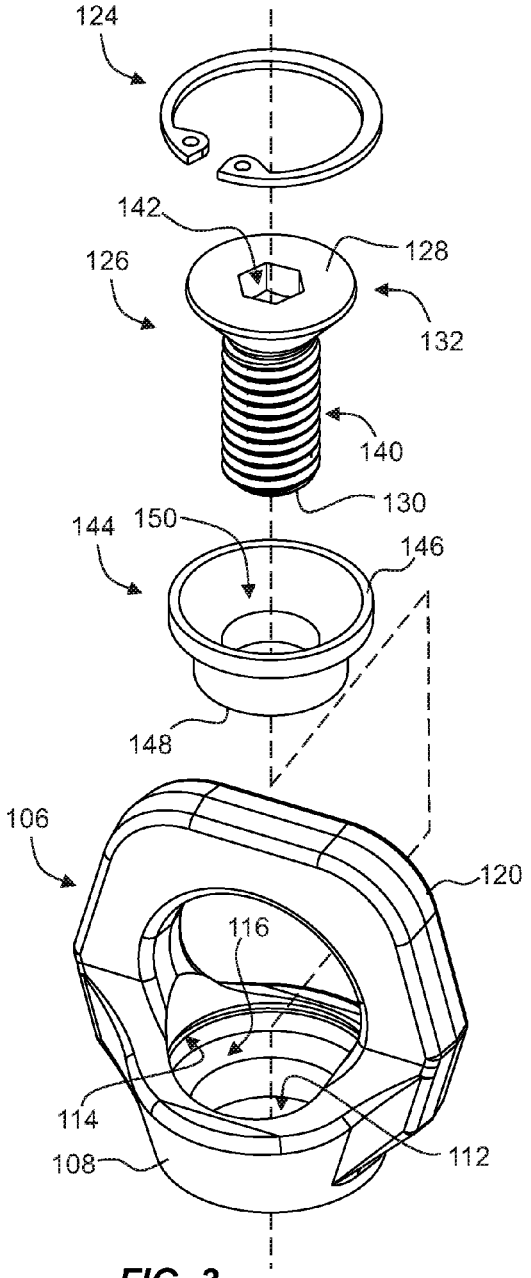
FIG. 3 is a diagrammatic exploded view of the example load-mountable lift eye assembly of FIG. 1.
Figure 4:
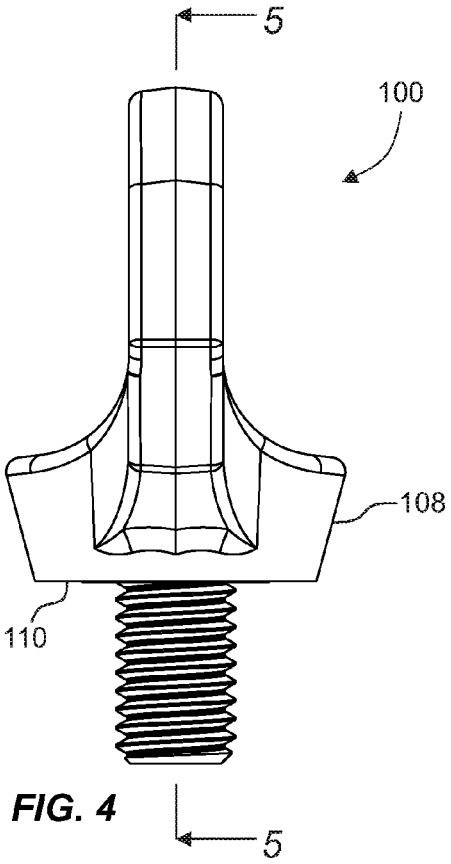
FIG. 4 is a diagrammatic side view of the example load-mountable lift eye assembly of FIG. 1.
Figure 5:
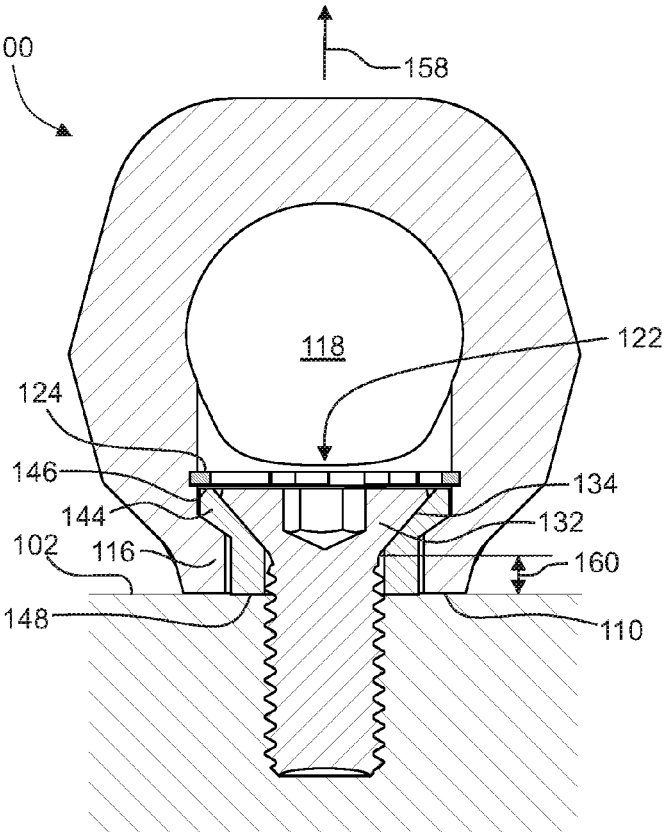
FIG. 5 is a diagrammatic cross-sectional view taken along lines 5-5 in FIG. 4, with the example load-mountable lift eye assembly being shown threadedly mounted to a load.
Figure 6:
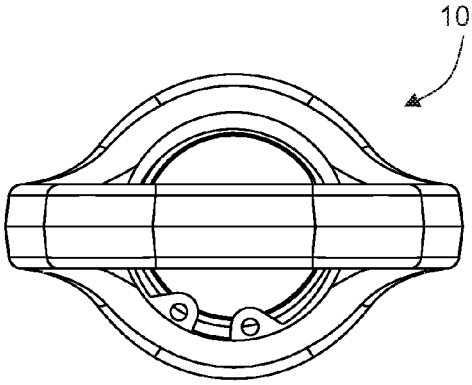
FIG. 6 is a diagrammatic top view of the example load-mountable lift eye assembly of FIG. 1.
Figure 7:
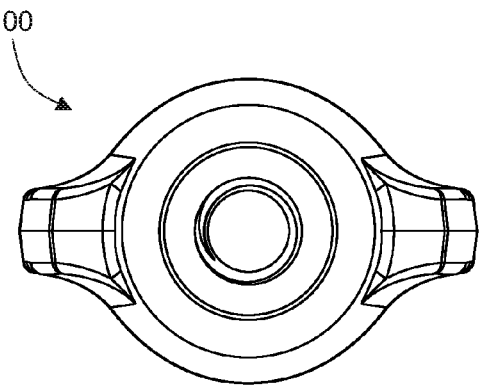
FIG. 7 is a diagrammatic bottom view of the example load-mountable lift eye assembly of FIG. 1.

Referring to FIGS. 1 and 3, the connection interface element 106 may include a mounting portion 108 and a hoop portion 120. The mounting portion 108 may have a mounting bore 112 extending along a main axis 104. A connection aperture 118 may preferably be defined by the connection interface element 106 so as to extend therethrough orthogonally to the main axis 104. Referring to FIGS. 3 and 5, the mounting bore 112 may have a shoulder flange 116 extending radially inwardly thereof.

Figure 14:
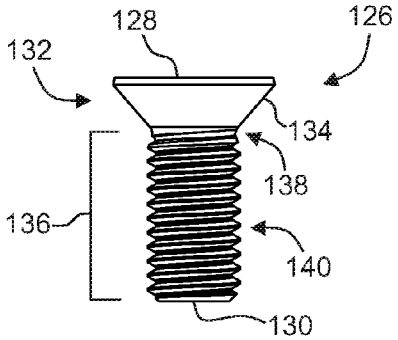
FIG. 14 is a diagrammatic side view of an example mounting coupler with a tapered support face and a threaded shaft portion.

Referring to FIGS. 3 and 14, the mounting coupler 126 may extend between a first end 128 and a second end 130, and may include a head portion 132 at the first end 128 and a shaft portion 136 extending from the second end 130 toward the head portion 132. The mounting coupler 126 may be configured to be received through the mounting bore 112 for placement in a mounting position with respect to the connection interface element 106 (such mounting positions being shown, for example, in FIGS. 5, 15 and 20). At least a segment of the shaft portion 136 may include threading 140, so as to facilitate threaded mounting of the assembly 100 to a load 102.

Figure 20:
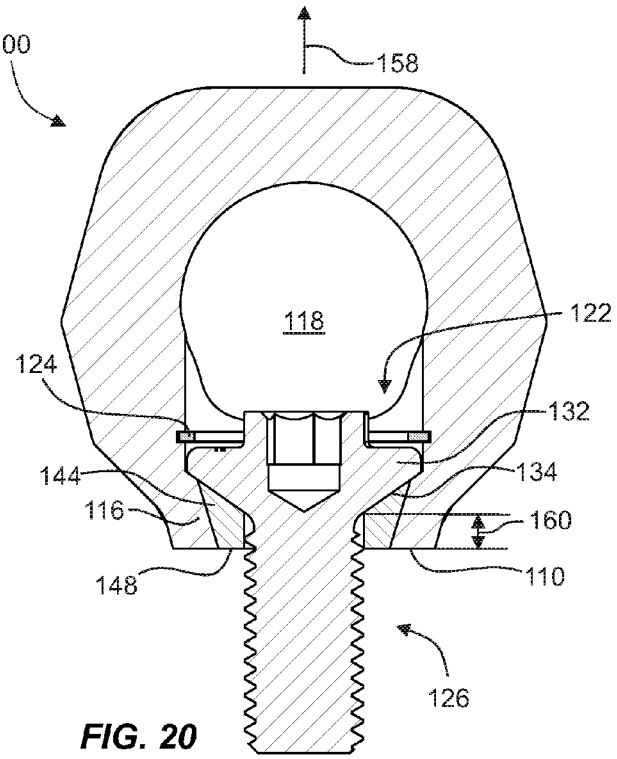
FIG. 20 is a diagrammatic cross-sectional view taken along lines 20-20 in FIG. 19.
Figure 21:
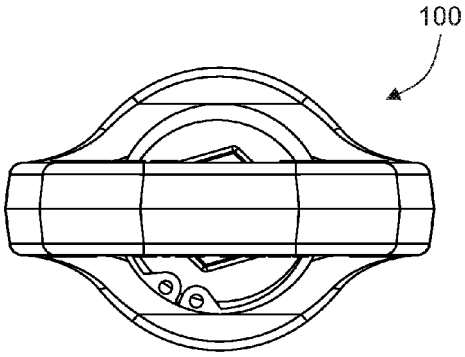
FIG. 21 is a diagrammatic top view of the example load-mountable lift eye assembly of FIG. 16.

Referring to FIGS. 3, 5 and 20, the axial retention element 124 may be configured to engage the mounting bore 112 so at the retain at least a segment of head portion 132 between the shoulder flange 116 and the axial retention element 124, thereby retaining the mounting coupler 126 in the mounting position and limiting axial movement of the mounting coupler 126 along the main axis 104 with respect to the mounting portion 108.

Figure 2:
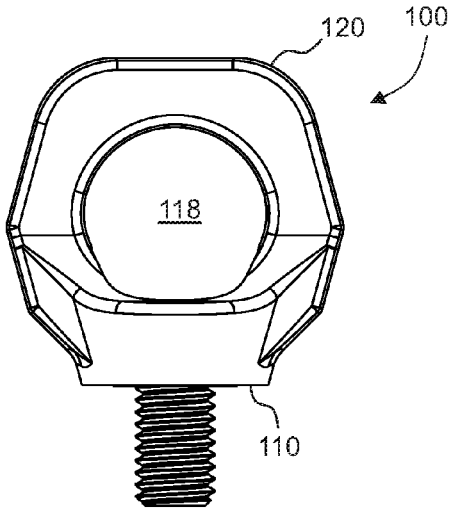
FIG. 2 is a diagrammatic front view of the example load-mountable lift eye assembly of FIG. 1.
Figure 15:
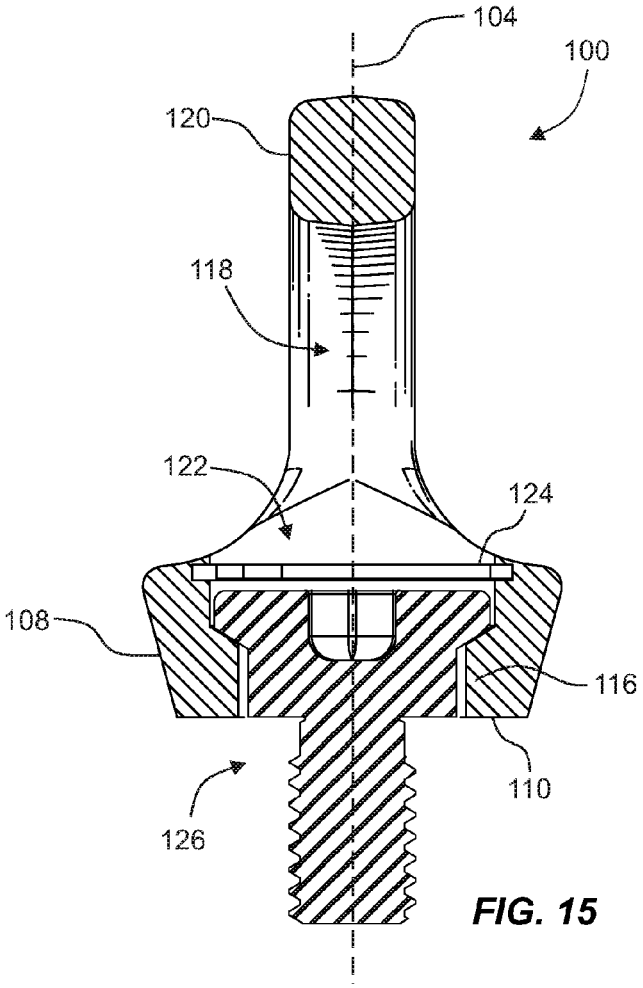
FIG. 15 is a diagrammatic cross-sectional view of an alternate example load-mountable lift eye assembly in accordance with the present disclosure.
Figure 16:
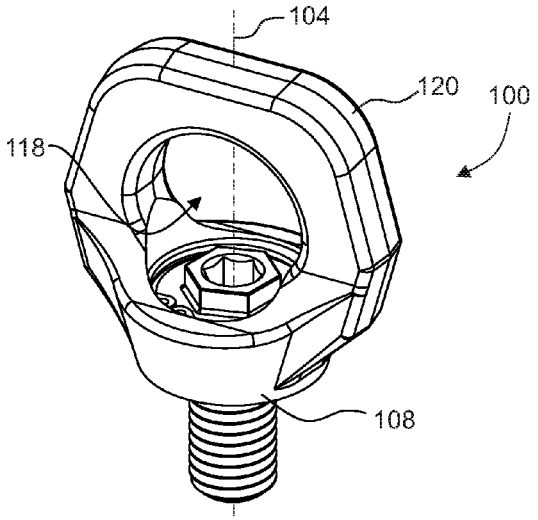
FIG. 16 is a diagrammatic perspective view of a further example load-mountable lift eye assembly in accordance with the present disclosure.
Figure 17:
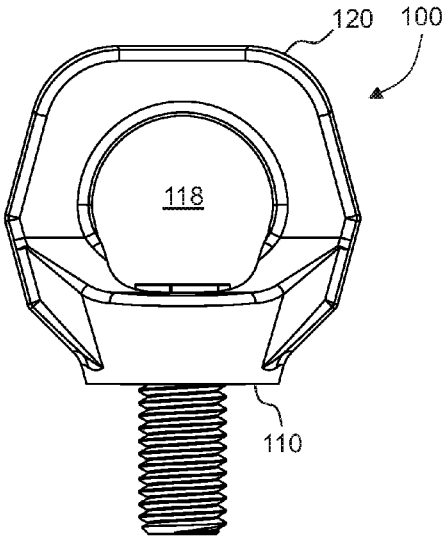
FIG. 17 is a diagrammatic front view of the example load-mountable lift eye assembly of FIG. 16.

Referring to FIGS. 2, 5 and 15, in certain preferred embodiments of the load-mountable lift eye assembly 100, when the mounting coupler 126 is in the mounting position, neither the head portion 132 nor the axial retention element 124 obstructs the connection aperture 118. In particular preferred embodiments of the assembly 100, the connection interface element 106 includes a recess portion 122 extending between the connection aperture and the axial retention element. Such recess portion 122 may facilitate the aforementioned lack of obstruction.

Referring to FIGS. 3 and 5, in particular preferred embodiments of the load-mountable lift eye assembly 100, the mounting bore 112 may include an axial retention groove 114 extending circumferentially therein, and the axial retention element 124 may be a c-clip configured to engage the axial retention groove 114. Such a c-clip may be easily installed and removed from the axial retention groove 114 using, for example, snap-ring pliers or the like.

Referring to FIGS. 3, 5 and 20, certain preferred embodiments of a load-mountable lift eye assembly 100 may further comprise a bushing element 144 disposed, for example, radially between the mounting coupler 126 and the mounting bore 112. In such embodiments, the engagement of the axial retention element 124 with the mounting bore 112 may also limit axial movement of the bushing element 144 along the main axis 104 with respect to the mounting portion 108. The bushing element 144 may include a proximal end 146, a distal end 148, a bushing bore 150, a head-engagement portion 152, and a shaft engagement-portion 154.

Referring to FIGS. 5, 14 and 20, in particular embodiments of a load-mountable lift eye assembly 100 the mounting coupler 126 may include a head-shaft interface 138 defined between the head portion 132 and the shaft portion 136, and the mounting portion 108 may include a mounting face 110 disposed oppositely of the hoop portion 120. In such an embodiment, when the mounting coupler 126 is in the mounting position, the head-shaft interface 138 may be axially offset (for example, by a moment offset distance 160) from the mounting face 110 in a direction inward 158 of the mounting face 110. More particularly, in certain embodiments of the assembly 100, the axial offset 160 may preferably be at least one-quarter or at least one-third the distance between the mounting face 110 and the first end 128. Alternatively, or in addition, when the mounting coupler 126 is in the mounting position, the head-shaft interface 138 may be configured to be axially aligned with the shoulder flange 116. See, for example, FIG. 5, where the head-shaft interface 138 shares a position along the main axis 104 with a segment of the shoulder flange 116.

Referring to FIGS. 3, 5, 13 and 20, in a load-mountable lift eye assembly 100 with a bushing element 144, the bushing element 114 may include a head engagement portion 152 tapered with respect to the main axis 104, and the head portion 132 may include a support face 134 disposed oppositely of the first end 128 and being tapered with respect to the main axis 104. In such embodiments, when the mounting coupler 126 is in its mounting position, the support face 134 may be in contact with the head engagement portion 152. This contact may preferably remain slidable (e.g., low friction), so as to allow the connection interface element 106 to rotate about the main axis 104 with respect to the mounting coupler 126 when the assembly is mounted to a load 102. Moreover, the bushing element 144 may include a shoulder engagement portion 156. In such case, when the mounting coupler 126 is in its mounting position, the shoulder engagement portion 156 may be configured to be in contact with the shoulder flange 116. The shoulder engagement portion 156 and the shoulder flange 116 include mutually-contacting faces which are tapered with respect to the main axis. This mutual contact may also remain slidable, so as to facilitate the ability of the connection interface element 106 to rotate about the main axis 104 with respect to the mounting coupler 126 when the assembly is mounted to a load 102.

Figure 8:
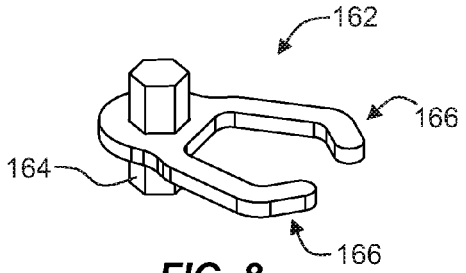
FIG. 8 is a diagrammatic perspective view of an example torqueing tool for potential use in association with embodiments of the assembly described herein.
Figure 9:
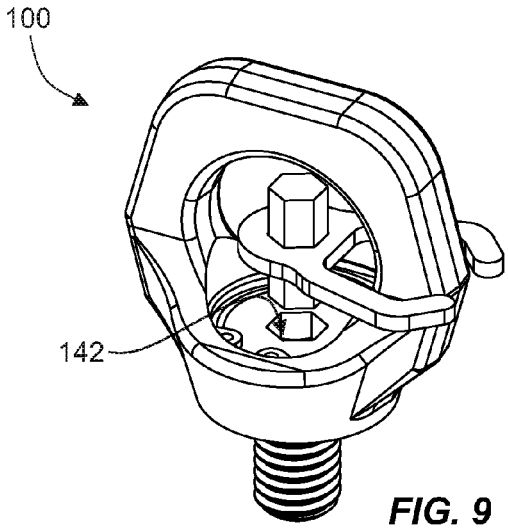
FIG. 9 is a diagrammatic perspective view of similar to that of FIG. 1, but shown with an example torqueing tool positioned within connection aperture and out of engagement with the tool engagement portion of the mounting coupler.
Figure 10:
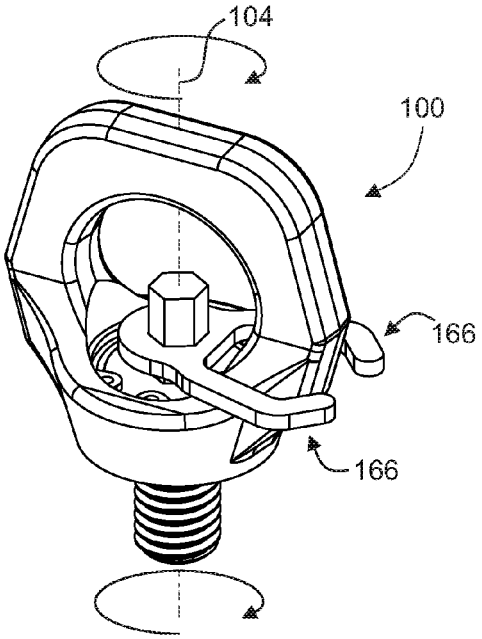
FIG. 10 is a diagrammatic perspective view of similar to that of FIG. 9, but shown with the head-engagement section of the torqueing tool in torque-transmitting engagement with the tool engagement portion of the mounting coupler.
Figure 11:
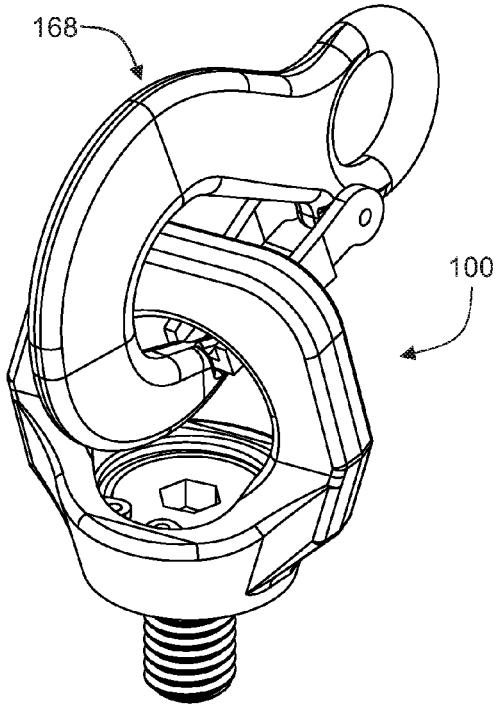
FIG. 11 is a diagrammatic perspective view of similar to that of FIG. 1, but shown with an example connection hook in secured receipt of the connection hoop.
Figure 12:
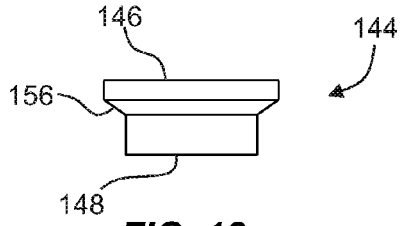
FIG. 12 is a diagrammatic side view of an example bushing element.
Figure 13:
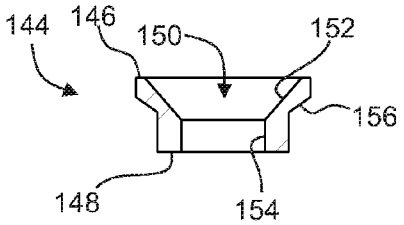
FIG. 13 is a diagrammatic cross-sectional view of the example bushing element of FIG. 12.
Figure 18:
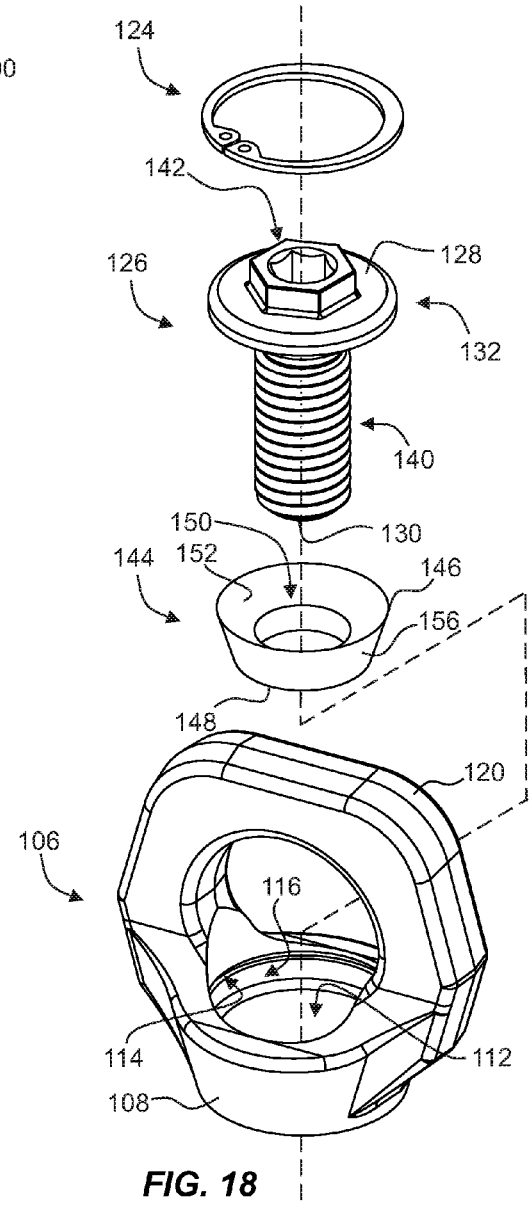
FIG. 18 is a diagrammatic exploded view of the example load-mountable lift eye assembly of FIG. 16.
Figure 19:
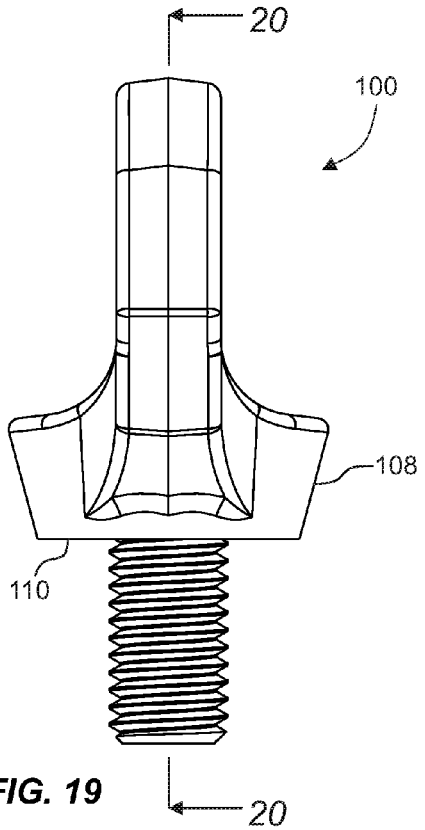
FIG. 19 is a diagrammatic side view of the example load-mountable lift eye assembly of FIG. 16.

Referring to FIGS. 3 and 18, in particular embodiments of a load-mountable lift eye assembly 100, the head portion 132 may include a tool engagement section 142 for engagement by a head-engagement section 164 of a torqueing tool 162. An example of such a torqueing tool is illustrated in FIG. 8, and may include a head-engagement section (single-sided, or double-sided as shown), and one or more rotation detent elements 166. As shown in FIG. 10, such a torqueing tool is capable of temporarily preventing rotation of the mounting coupler 126 with respect to the connection interface element 106. In this torque-locked configuration, the mounting coupler 126 may be rotated about the main axis 104 (e.g., for threading into or out of the load 102) by applying a corresponding rotating torque to the connection interface element 106. The one or more rotation detent elements 166 may be configured to retain the torque tool 162 on the hoop portion 120, even when the head engagement section 164 is moved clear of the connection aperture 118. FIG. 11 illustrates an example connection hook 168 in secured receipt of the hoop portion 120.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A load-mountable lift eye assembly comprising:

a connection interface element including a mounting portion and a hoop portion, the mounting portion having a mounting bore extending along a main axis, a connection aperture being defined by the connection interface element so as to extend therethrough orthogonally to the main axis, the mounting bore having shoulder flange extending radially inwardly thereof;

a mounting coupler extending between a first end and a second end, and including a head portion at the first end and a shaft portion extending from the second end toward the head portion, the mounting coupler being configured to be received through the mounting bore for placement in a mounting position with respect to the connection interface element;

an axial retention element configured to engage the mounting bore so as to retain at least a segment of the head portion between the shoulder flange and the axial retention element, thereby retaining the mounting coupler in the mounting position and limiting axial movement of the mounting coupler along the main axis with respect to the mounting portion; and a bushing element disposed radially between the mounting coupler and the mounting bore;

wherein (a) the mounting coupler includes a head-shaft interface defined between the head portion and the shaft portion;

(b) the mounting portion includes a mounting face disposed oppositely of the hoop portion;

(c) when the mounting coupler is in the mounting position, the head-shaft interface is axially offset from the mounting face in a direction inward of the mounting face;

(d) the bushing element includes a head engagement portion tapered with respect to the main axis;

(e) the head portion includes a support face disposed oppositely of the first end and being tapered with respect to the main axis; and (f) when the mounting coupler is in the mounting position, the support face is in contact with the head engagement portion.

2. A load-mountable lift eye assembly as defined in claim 1, wherein when the mounting coupler is in the mounting position, neither the head portion nor the axial retention element obstructs the connection aperture.

3. A load-mountable lift eye assembly as defined in claim 2, wherein the connection interface element includes a recess portion extending between the connection aperture and the axial retention element.

4. A load-mountable lift eye assembly as defined in claim 1, wherein (a) the mounting bore includes an axial retention groove extending circumferentially therein; and (b) the axial retention element is a c-clip configured to engage the axial retention groove.

5. A load-mountable lift eye assembly as defined in claim 1, wherein the engagement of the axial retention element with the mounting bore also limits axial movement of the bushing element along the main axis with respect to the mounting portion.

6. A load-mountable lift eye assembly as defined in claim 1, wherein the axial offset is at least one-quarter the distance between the mounting face and the first end.

7. A load-mountable lift eye assembly as defined in claim 1, wherein the axial offset is at least one-third the distance between the mounting face and the first end.

8. A load-mountable lift eye assembly as defined in claim 1, wherein when the mounting coupler is in the mounting position, the head-shaft interface is axially aligned with the shoulder flange.

9. A load-mountable lift eye assembly as defined in claim 1, wherein (a) the bushing element includes a shoulder engagement portion; and (b) when the mounting coupler is in the mounting position, the shoulder engagement portion is in contact with the shoulder flange.

10. A load-mountable lift eye assembly as defined in claim 9, wherein the shoulder engagement portion and the shoulder flange include mutually-contacting faces which are tapered with respect to the main axis.

11. A load-mountable lift eye assembly as defined in claim 1, wherein at least a segment of the shaft portion includes threading.

12. A load-mountable lift eye assembly as defined in claim 1, wherein the head portion includes a tool engagement section for engagement by a head-engagement section of a torqueing tool.

13. A load-mountable lift eye assembly as defined in claim 1, wherein the bushing element and the first end are simultaneously engageable by the axial retention element.

14. A load-mountable lift eye assembly as defined in claim 13, wherein the bushing element extends axially along the main axis from the mounting face to the first end.

15. A load-mountable lift eye assembly as defined in claim 1, wherein (a) the bushing element includes a proximal end and a distal end, (b) the proximal end is in-plane with the first end, and (c) the distal end is in-plane with the mounting face.

16. A load-mountable lift eye assembly comprising:

a connection interface element including a mounting portion and a hoop portion, the mounting portion having a mounting bore extending along a main axis, a connection aperture being defined by the connection interface element so as to extend therethrough orthogonally to the main axis, the mounting bore having shoulder flange extending radially inwardly thereof;

a mounting coupler extending between a first end and a second end, and including a head portion at the first end and a shaft portion extending from the second end toward the head portion, the mounting coupler being configured to be received through the mounting bore for placement in a mounting position with respect to the connection interface element;

an axial retention element configured to engage the mounting bore so as to retain at least a segment of the head portion between the shoulder flange and the axial retention element, thereby retaining the mounting coupler in the mounting position and limiting axial movement of the mounting coupler along the main axis with respect to the mounting portion; and a bushing element disposed radially between the mounting coupler and the mounting bore;

wherein (a) the mounting bore includes an axial retention groove extending circumferentially therein;

(b) the axial retention element is a c-clip configured to engage the axial retention groove;

(c) the mounting coupler includes a head-shaft interface defined between the head portion and the shaft portion;

(d) the mounting portion includes a mounting face disposed oppositely of the hoop portion;

(e) when the mounting coupler is in the mounting position, the head-shaft interface is axially offset from the mounting face in a direction inward of the mounting face;

(f) the bushing element includes a head engagement portion tapered with respect to the main axis;

(g) the head portion includes a support face disposed oppositely of the first end and being tapered with respect to the main axis;

(h) when the mounting coupler is in the mounting position, the support face is in contact with the head engagement portion;

(i) the bushing element includes a shoulder engagement portion; and (j) when the mounting coupler is in the mounting position, the shoulder engagement portion is in contact with the shoulder flange.

17. A load-mountable lift eye assembly as defined in claim 16, wherein the axial offset is at least one-quarter the distance between the mounting face and the first end.

18. A load-mountable lift eye assembly as defined in claim 16, wherein the axial offset is at least one-third the distance between the mounting face and the first end.

19. A load-mountable lift eye assembly as defined in claim 16, wherein when the mounting coupler is in the mounting position, the head-shaft interface is axially aligned with the shoulder flange.

* * * * *